US005421701A

United States Patent [19]

Funston

[11] Patent Number: 5,421,701

[45] Date of Patent: Jun. 6, 1995

[54] FAN FOR AN INCANDESCENT LIGHT BULB FIXTURE

[76] Inventor: Lance T. Funston, 2044 Spruce St., Philadelphia, Pa. 19103

[21] Appl. No.: 217,339

[22] Filed: Mar. 24, 1994

[51] Int. Cl.[6] ..... B42F 13/00

[52] U.S. Cl. ..... 415/5

[58] Field of Search ..... 415/5, 206

[56] References Cited

U.S. PATENT DOCUMENTS

| | | | |
|---|---|---|---|
| 1,935,314 | 11/1933 | Finch | 416/206 |
| 2,434,130 | 1/1948 | Turner | 416/5 |
| 4,396,352 | 8/1983 | Pearce | 416/206 |
| 5,077,825 | 12/1991 | Monrose | 416/5 |
| 5,135,365 | 8/1992 | Bogage | 416/5 |
| 5,154,579 | 10/1992 | Rezek | 416/5 |
| 5,195,870 | 3/1993 | Liu | 416/5 |
| 5,302,083 | 4/1994 | Bucher et al. | 416/5 |

FOREIGN PATENT DOCUMENTS

| | | | |
|---|---|---|---|
| 223834 | 10/1942 | Switzerland | 416/5 |

*Primary Examiner*—John T. Kwon

*Attorney, Agent, or Firm*—Panitch Schwarze Jacobs & Nadel

[57] ABSTRACT

A ceiling fan is adapted to engage the socket of an incandescent light bulb ceiling fixture and includes a neck having a base shell with external helical threads and a central contact that match those of conventional incandescent light bulb for mating receipt in a conventional light bulb socket. The central contact of the neck is electrically isolated from the base shell. An electric motor drives a hub in a predetermined direction and derives power through the base shell and central contact from the incandescent bulb socket that receives the neck. The ceiling fan may be provided with a fluid or other cushioning coupling between the motor and a rotatable hub that yields a cushioning effect so as not to disturb the mating between the neck of the ceiling fan and the incandescent bulb socket. Furthermore, the direction in which the vane elements of the fan and the motor are rotated is selected to cause any reactionary torque to tighten the coupling between the neck of the ceiling fan and the incandescent bulb socket.

16 Claims, 4 Drawing Sheets

FAN FOR AN INCANDESCENT LIGHT BULB FIXTURE

FIELD OF THE INVENTION

The invention relates to electric fans and, more particularly, to fans combined with electric light fixtures.

BACKGROUND OF THE INVENTION

Ceiling fans are not only energy savers but also provide a more pleasant environment in domestic, commercial, and industrial applications. In the summer, during hot weather, ceiling fans make air conditioners more efficient by circulating cool air. During cold weather, the fan circulates warm air which would otherwise be trapped near the ceiling. During marginal air-conditioning weather, the fan alone can be used to provide relief from the heat, and the fan, which has a relatively small motor, will operate at a fraction of the cost of an air-conditioning unit.

Electrical boxes can be installed in ceilings to accommodate the mounting of various fixtures that include the ceiling fan, a lightweight lighting fixture and even a relatively heavy lighting fixture. The mounting of the lightweight lighting fixture is typically accommodated by the use of a strap that is connected, by means of mounting screws, to an electric box which is nailed or otherwise fastened to structural members above the ceiling. The lightweight lighting fixture typically comprises a fixture ceiling plate connected to the strap of the electrical box, a small pipe acting as a conduit for electrical wires, and one or more sockets each for an incandescent lamp.

The mounting of the relatively heavy fixture is typically accomplished by the use of a hanging bar that passes through the electrical box in the ceiling and to which is attached a so-called "nipple" having legs that encircle the hanging bar. The heavy light fixture also typically has a so-called "hickey" to which is attached a fixture ceiling plate that carries along with it one or more sockets for incandescent lamps and related conduits for associated electrical wires. The hickey is threadingly connected to the nipple so that the relatively heavy light fixture is directly supported by the hanging bar. The mounting of the ceiling fan is typically accomplished by the use of a 2×4 block, which is connected between floor joists or rafters above the ceiling and to which the electrical box is attached.

Of the different ceiling mounting arrangements, undoubtedly the lightweight lighting fixture that houses the incandescent lamp is the most popular and is most commonly found in domestic, commercial, and industrial establishments. Although lightweight lighting fixtures have severe limitations regarding their weight bearing strengths, it would be very desirable to place a ceiling fan into these lightweight fixtures and to do so without retrofitting or structurally modifying the ceiling mounting arrangements in any manner to accommodate the ceiling fans. If possible, the incandescent socket would provide both the mechanical and electrical connections for the ceiling fan. If such a placement could be provided, the benefits of a ceiling fan could be immediately realized without suffering the disadvantages of structurally modifying the ceiling's mounting.

SUMMARY OF THE INVENTION

The present invention is a ceiling fan comprising a neck with a conductive base shell having exposed, generally helical threads and a central contact at a distal end of the neck. The central contact is electrically isolated from the base shell in the neck. The fan further comprises an electric motor with a first shaft. The motor is coupled in circuit with said conductive base shell and said central contact. Said fan further comprises a hub rotated by said first shaft and a plurality of vanes projecting outwardly from said hub.

BRIEF DESCRIPTION OF THE DRAWINGS

The foregoing summary, as well as the following detailed description of the preferred embodiments, will be better understood when read in conjunction with the appended drawings. For the purpose of illustrating the invention, there is shown in the drawings embodiments which are presently preferred, it being understood, however, that the invention is not limited to the specific methods and instrumentalities disclosed. In the drawings.

DESCRIPTION OF THE PREFERRED EMBODIMENTS

Figure 1:
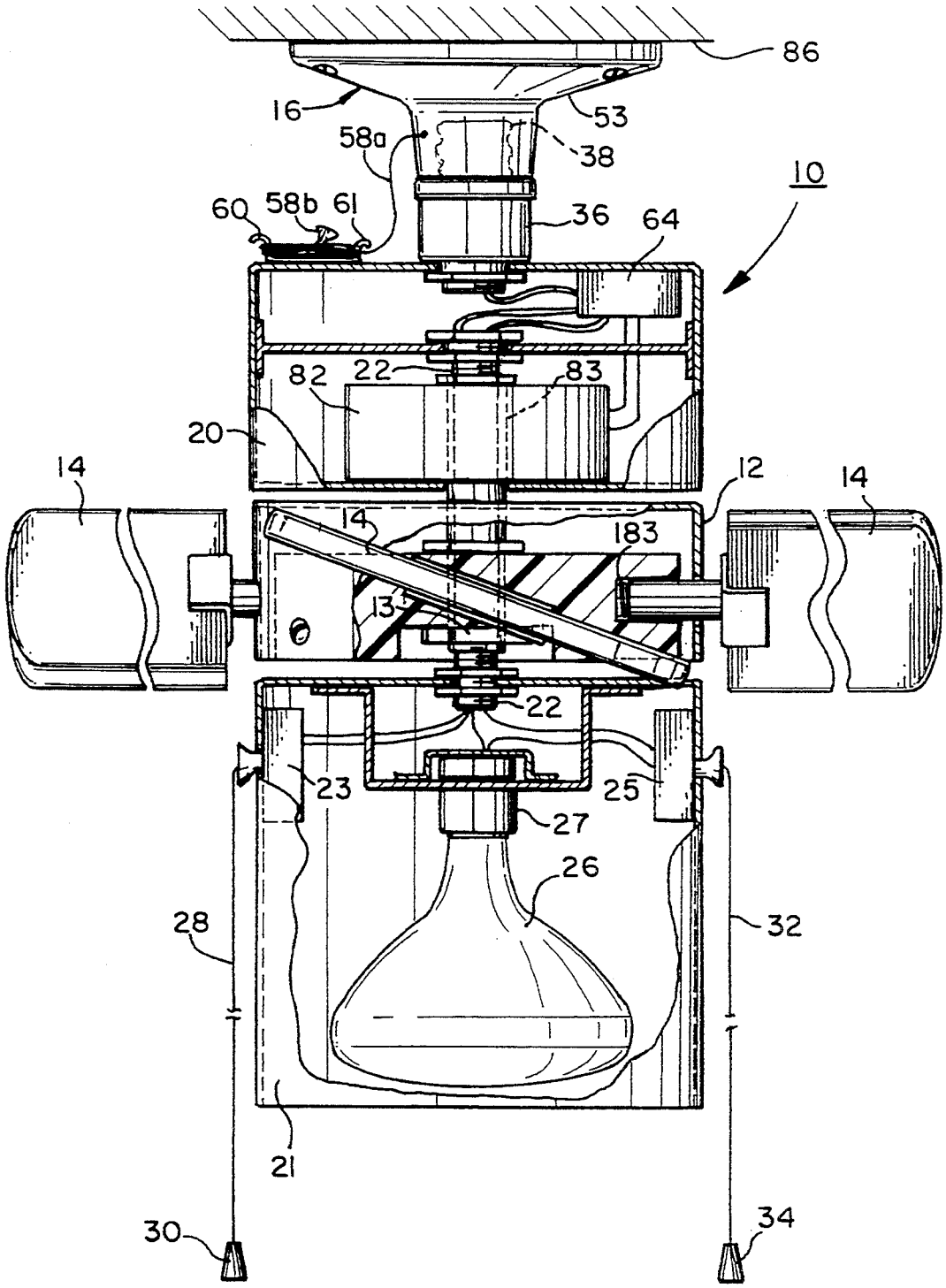
FIG. 1 is a partially broken away side elevation of a first embodiment ceiling fan of the present invention.

In the drawings, wherein like numbers indicate like elements throughout, there is shown in FIG. 1 a first embodiment ceiling fan 10 embodying principles of the present invention. In the summer, during hot conditions, the ceiling fan 10 makes air conditioners more efficient by circulating cool air. In the winter, during cold conditions, the ceiling fan 10 circulates warm air that would otherwise be trapped close to the ceiling. During temperate conditions, the ceiling fan 10, acting alone, moves the air within a room so as to make the environment within the room more pleasant.

Figure 3:
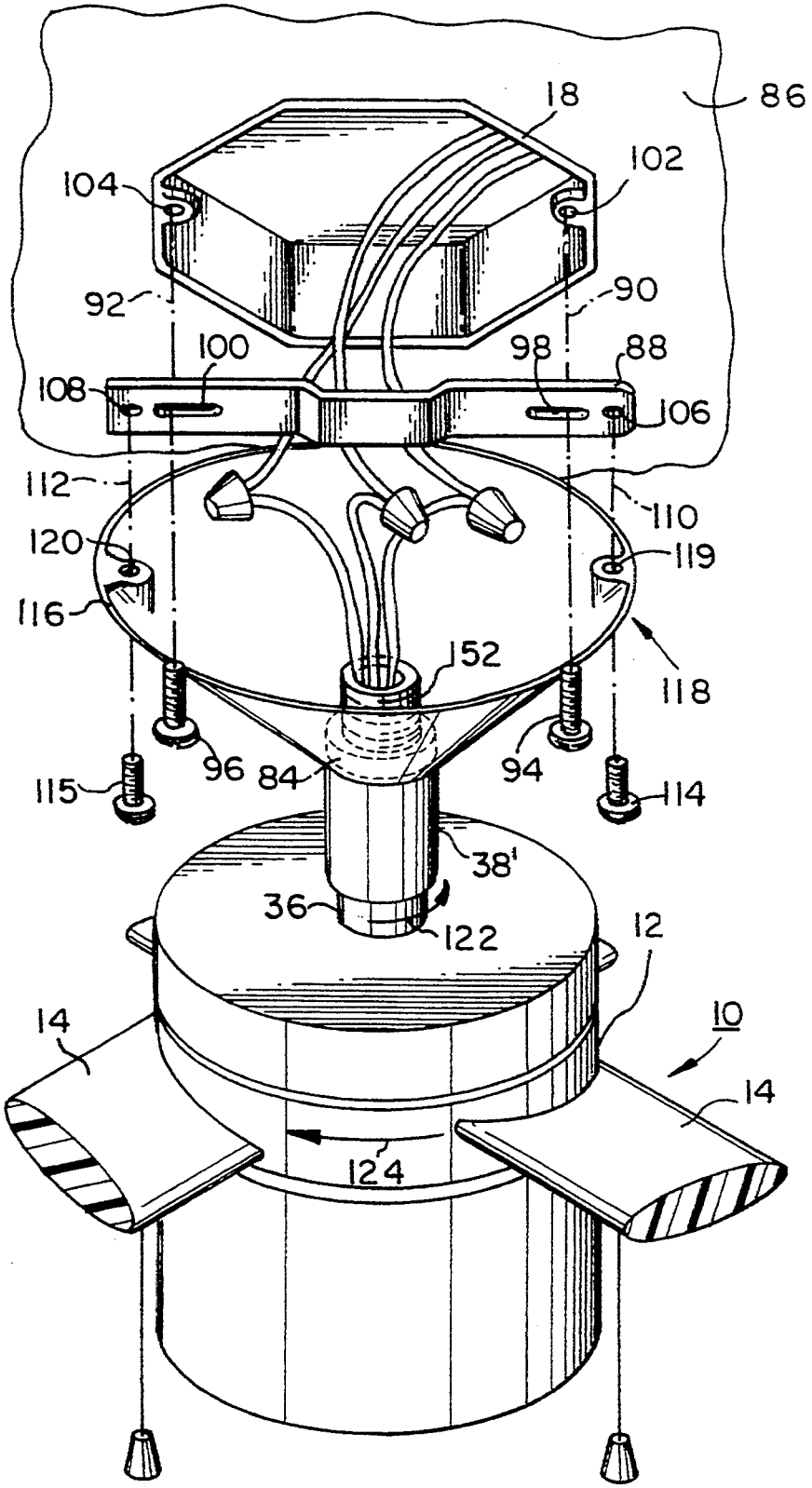
FIG. 3 is an exploded view illustrating details of the interrelationship between the ceiling fan of FIG. 1 and an electrical box mounted above a ceiling through a ceiling plate type of fixture.

According to a primary feature of the present invention, fans are configured to be supported by and to derive their electric power from standard incandescent light bulb sockets. The ceiling fan 10 may otherwise be conventional and have various shapes and forms. In FIG. 1, a fan 10 is shown as having a generally cylindrical shape with generally cylindrical housings 20 and 21 and a correspondingly cylindrical hub 12 therebetween on which a plurality of vanes 14 are mounted. The vanes 14 radiate at least generally radially outwardly from the hub 12. Vanes 14 are preferably formed of a plastic material or other rigid but lightweight material and may be hollow or porous, preferably with a paddle shape. Each radiating vane 14 may have a length in the range from about one-half foot to about three feet. Fan 10 is configured by the provision of a neck 36 to electrically and mechanically mate with an incandescent light bulb socket 38 forming the receptacle of a downwardly directed ceiling light fixture 16 or other standard light fixture. As indicated in FIG. 3, the fixture in turn, is connected to an electrical box 18 mounted above ceiling 86.

Housing 21 may, for example enclose a terminal connection junction 64 and motor 82. A hollow drive shaft 83 may extend downwardly from motor 82 to be affixedly attached to hub 12 by suitable means such as a lock nut 13. Housings 20, 21 may be fixedly coupled together by means of a second, hollow, tubular member 22, which passes through hollow drive shaft 83.

A multi-speed switch 23 is used to control the speeds of the motor of the ceiling fan 10 and an on-off switch 25 is used to control the excitation applied to an incandescent bulb 26 that preferably is provided extending downwardly from the free lower end of the ceiling fan 10 in lower housing 21 from its own socket 27. The multi-speed switch 23 has attached thereto a pull member in the form of a string 28 with handle 30. Similarly, the on-off light switch 25 has attached thereto a pull member in the form of a string 32 with handle 34. Wires coupling switches 23, 25 with the terminal connection junction 64 and motor 82 in upper housing 20 may be passed through the hollow tubular member 22. The electrical connections of the switches 23 and 25, as well as the electrical connections of other elements of the ceiling fan 10 are further described with reference to FIG. 2.

Figure 2:
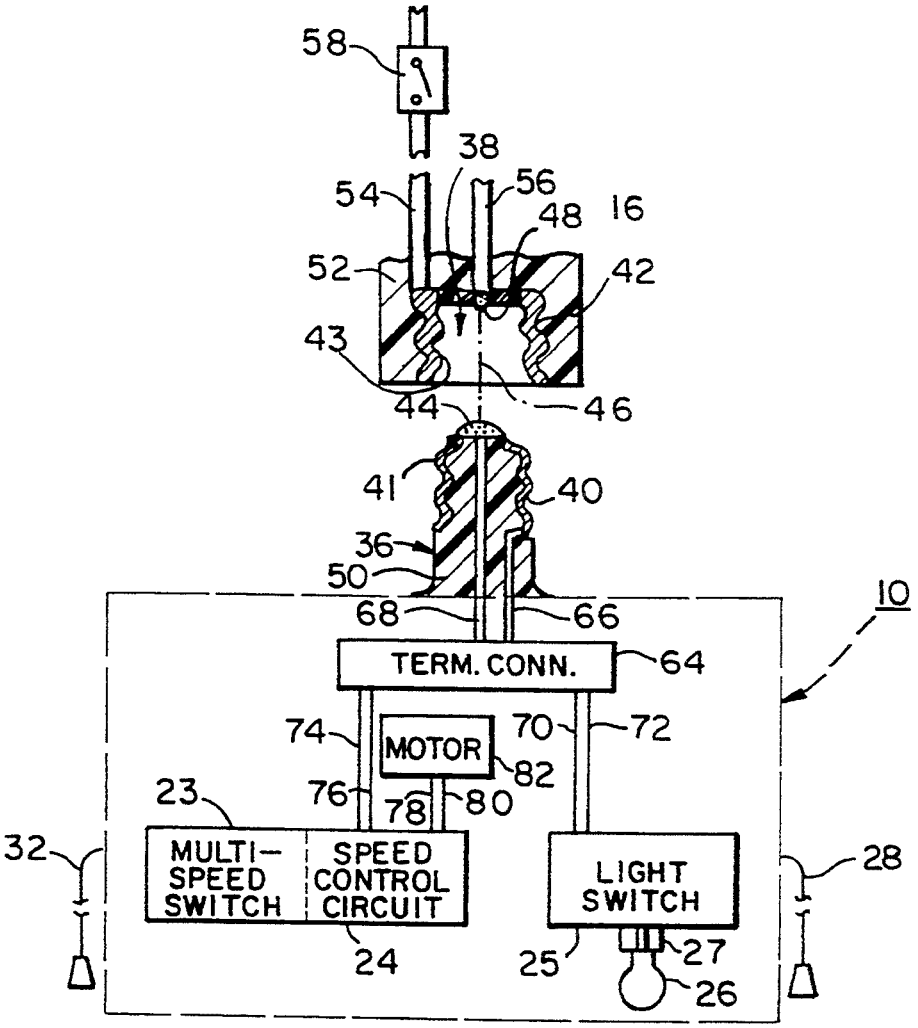
FIG. 2 is a schematic primarily illustrating the electrical components of the ceiling fan of FIG. 1.

FIG. 2 is a schematic generally illustrating some of the structural features of the ceiling fan 10 but, more particularly, illustrating the electrical layout of the ceiling fan 10, which is physically supported by and receives its electrical power by way of its neck 36, that is shown in its non-engaged state with a standard, conventional incandescent light bulb socket 38. The neck 36 includes a conductive, cylindrical base shell 40 with exposed threads 41, which are at least sufficiently helical to at least functionally match those of a standard incandescent light bulb and which extend along the outer surface of the base shell 40 and neck 36. The helical threads 41 screw into and are threadingly received by complementary helical threads 43 of a hollow, cylindrical shell portion 42 of the socket 38 of fixture 16 (see FIG. 1). The neck 36 further has a central contact 44 at a distal end of both the neck 36 and base shell 40, which mates with the incandescent socket 38, along central axis 46 of socket 38, so as to frictionally engage a centrally located base contact 48 of the socket 38. The base shell 40 and the central contact 44 are electrically isolated from each other by suitable means such as by being molded respectively on and in an insulative plastic body 50. In a similar manner, the shell 42 of socket 38 is electrically isolated from the base contact 48 in a conventional manner. In FIG. 2, the incandescent lamp socket 38 is affixed in a conventional fashion in an electrically insulated tubular member 52, which supports and protects shell portion 42. The member 52 may be a molded plastic body as shown. In FIG. 1, a standard and conventional single bulb ceiling fixture 16 is indicated with a ceramic body 53, which functions as at least part of a tubular support member. A first wire 54 is connected to the shell portion 42 of the incandescent lamp socket 38 while a second electrical wire 56 is connected to the base contact 48.

The fixture 16 may have an on-off switch 58 that is in circuit with either the base contact 48 or the shell 42. In FIG. 2 such a switch 58 is shown connected to the shell 42. The on-off switch 58 may be provided on the fixture 16 to control an incandescent light bulb (not shown) normally received in the socket 38, but serves no useful purpose in at least some embodiments of the present invention and should be switched to its on condition or state so that the ceiling fan 10 of the present invention may be energized and controlled by its own switches 23 and 25, if provided. However, the switch 58 may have a pull member, such as a string **58*a* to which might be attached a handle 58*b* (see FIG. 1), either of which may disadvantageously come into contact with a rotating vane 14. In most ceiling fixtures 38 with a pull member operated switch, a key chain type ball/socket snap connector is used, which permits the pull member to be unsnapped from the fixture. However, if the pull member 58*a* is not removable, as seen in FIG. 1, the handle 58*b* and string 58*a* are kept out of contact with the rotating vanes 14 by being wrapped around and possible jammed between two clip protrusions 60 and 61 that may be provided to extend outwardly from the upper housing 20**.

FIG. 2 further illustrates that the base shell 40 and central base contact 44 of the neck 36 are respectively routed to the terminal connection junction 64 within fan 10 by means of conductors 66 and 68. Switches 23 and 25 are coupled in circuit between terminal connection 64 and fan motor 82 and fan light bulb socket 27, respectively. In particular, wires 66 and 68 are further joined to form first and second paths, with the first path comprising wires 70 and 72 connected to the on-off switch 25 and the second path comprising wires 74 and 76 routed to a speed control circuit 24 (eg. off, slow, medium and fast), that is responsive to the multi-speed switch 23 and may be combined with it as a single component. It is desired that two separate paths be provided so that the incandescent bulb 26 is always provided with the full excitation by way of on-off switch 25, when needed, and is not affected by the variation of the excitation accomplished by the speed control circuit 24 associated with or part of switch 23.

Speed control circuits, such as circuit 24, which are responsive to a multi-speed switch like switch 23, are well known in the art and, therefore, are not to be described in detail herein. Typically, the speed control circuit 24 adjusts or controls the excitation applied through wires 78 and 80 across the input windings (not shown) of motor 82 so that the speed of the motor 82 of the ceiling fan 10 is cycled from off, to slow, to medium to relatively fast speed and back to off. If desired, the speed control circuit 24 may be removed and, concurrently, the switch 23 may be selected to be an on-off type that is interposed between either of the wires 74 or 76 and either of the ends of the wires 78, 80 to the motor 82. In the simplest form, a wall switch, if provided to control operation of fixture 38 with a bulb, can also be used to turn a fan of the present invention off and on, albeit at some fixed speed.

The interrelationship between the ceiling fan 10, and the electrical box 18 located above the ceiling is further described with reference to FIG. 3 and with respect to a ceiling plate type light fixture indicated generally at 118. FIG. 3 shows the neck 36 of the ceiling fan 10 mated with the incandescent socket 38' of a ceiling plate type fixture 118 which, in turn, is mated through a pipe-like tubular member 152 to electrical box 18. More specifically, the pipe-like member 152 is connected to the fixture ceiling plate 116 of fixture 118 by means of an appropriate connector, such as a threaded nut 84, shown in phantom. The electrical box 18 is held in place commonly by fastening means, such as nails, affixing the electrical box 18 to one or more joists or rafters (not shown) in the ceiling 86. A strap 88 is then positioned along lines 90 and 92 so that respective screws 94 and 96 may be respectively inserted through elongated openings 98 and 100 of the strap 88 allowing the screws 94 and 96 to be threadingly connected to appropriate tapped and threaded openings 102 and 104 of the electrical box 18. The fixture ceiling plate 116 is then connected to tapped and threaded openings 106 and 108 of the strap 88 by positioning fixture ceiling plate 116 along lines 110 and 112 so that screw members 114 and 115 may be respectively inserted through openings 119 and 120 of the fixture ceiling plate 116 allowing the plate 116 to be rigidly affixed to strap 88 through threaded screw receiving openings 106 and 108. Since the ceiling plate 116 is engaged to the strap 88, plate 116 is rigidly affixed to the electrical box 18. However, the ability of the strap 88 to support the fixture ceiling plate 116, carrying with it the incandescent bulb socket 38 and ceiling fan 10, has severe strength limitations. The present invention accommodates such strength limitations by a variety of devices.

First, the ceiling fan 10 is selected so that all or at least essentially all of its structural members, except the motor 82 and certain electrical elements, are of a lightweight material, such as plastic. The motor 82, and the other switches, circuits and contacts need to comprise metallic and magnetic components in order to maintain their performance characteristics. Vanes 14 may also be hollow or foam, but may have to be reinforced by ribbing in a conventional fashion. However, the selection of a lightweight material(s) and construction(s) for the other elements of the ceiling fan 10 reduces the weight which the socket 38/38' and the electrical box 18 and/or, strap 88, if used, need to withstand when the neck 36 of the ceiling fan 10 is inserted into the incandescent bulb socket 38' (or 38).

Fan 10 will develop a reactionary torque along neck 36 from rotating hub 12 and vanes 14. To prevent fan 10 from loosening itself, a preferential selection is made between the direction of rotation of the motor 82 of the ceiling fan 10 and the direction in which the neck 36 is screwed into the incandescent socket 38. For example, typically the neck 36 is screwed into the incandescent socket 38 in a clockwise direction (arrow 122 in FIG. 3) because the threads of a typical incandescent socket run inwardly in a clockwise direction. The direction of rotation of motor 82 is selected to be in an opposite or counterclockwise (shown by arrow 124) direction. When activated, the motor 82 causes the hub 12 to rotate the vanes 14 in a counterclockwise direction 124 and any reactionary torque developed by the motor 82 to move the hub 12 will be in a clockwise direction 122 and will tend to tighten, rather than loosen, the mating between the neck 36 and the incandescent socket 38 or 38'. Similarly, in industrial applications, wherein the neck 36 would commonly be inserted into the incandescent socket in a counterclockwise direction, commonly corresponding to the so-called "left-handed thread," the direction of rotation of the motor 82, and thus hub 12 and vanes 14, would be selected to be clockwise. Since the direction of the helical threads 41 on neck 36 is established at manufacture, motor 82 is similarly connected in circuit with base shell 40, central contact 44, terminal connector 64 and switch 78 to rotate hub 12 in the opposite direction.

Further, the motor 82 is preferably selected to be non-reversible so that once its clockwise or counterclockwise rotation is established, any reactionary torques will always tend to tighten rather than loosen the engagement between the neck 36 and the incandescent socket 38.

Figure 4:
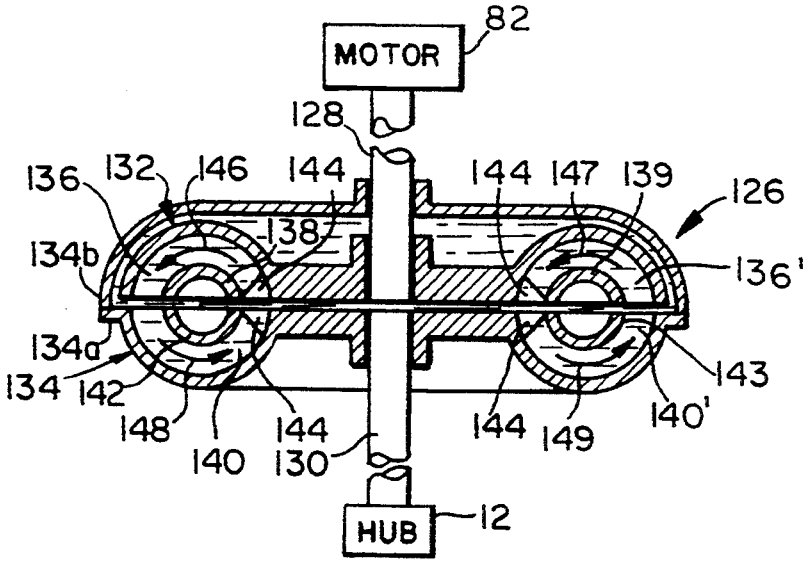
FIG. 4 is a schematic diagram of a fluid coupling embodiment of the present invention.

A means for reducing torsional vibrations to which the neck 36 and the incandescent socket 38 may be subjected is further described with reference to FIG. 4. FIG. 4 illustrates a coupling 126 between a motor drive shaft 128 to a second shaft 130 fixed to hub 12 which, in turn, rotates the one or more vanes as shown in FIG. 1. Torsion is transmitted solely by means of a fluid, such as a viscous oil in a toroidal housing portion 134 of the coupling 126. The start-up and stopping torques, torsional vibration and shocks from vane contacts or other sources on either shaft 128 or 130 are reduced or even eliminated because of dampening effect of the fluid coupling.

Coupling 126 has oppositely disposed impeller and turbine components 132 and 134 respectively shown in cross hatch and solid, which are respectively and rigidly connected to the shafts 128 and 130. The impeller component 132 is generally semi-torsional in shape and includes a plurality of nearly semi-annular, identical vanes 136, 136' which project downwardly. Lips 138, 139 are provided projecting outwardly from either side of vanes 136, 136' along the inner circumferential edge of each vane 136, 136' to direct fluid in the directions of arrows 146, 147, respectively, on either side of the vanes 136, 136', respectively from and towards openings 144.

Turbine component 134 is generally toroidal with a semi-toroidal base 134 and semi-toroidal cover **134*b*. A plurality of nearly semi-annular vanes 140, 140' project upwardly from base 134*a*. Each vane 140, 140' also includes a pair of semi-annular lips 142, 143, which project outwardly form opposing sides of each vane 140, 140' along the inner circumferential edge of the vane 140, 140'. Vanes 140, 140' and lips 142, 143 direct the working fluid received from vanes 136, 136', respectively, in the directions indicated by arrows 148, 149. Vanes 136, 136', 140, 140' should be configured and oriented to most efficiently transfer torque in the desired rotational direction of hub 12, to reduce the likelihood that the fan 10 will unscrew itself while slowing down when motor 82** is switched off.

In operation, the motor 82 drives the shaft 128 which in turn drives impeller 132 causing vanes 136, 136', to move viscous fluid in the direction shown by arrows 146 and 147 respectively. The momentum imparted to viscous fluid by vanes 136, 136' is respectively transferred to the vanes 140, 140' which, in turn, drive second shaft 130 fixed with hub 12.

At start-up, shaft 128 rotates while the shaft 130 does not and, therefore, the so-called slip factor is 100% (or nearly 100%). This slip factor decreases after shaft 130 begins to rotate, but never reaches zero. The acceleration and deceleration of the shaft 130 is smooth under all conditions and thereby eliminates the torsion vibrations or shocks that either shaft 128 or 130 might otherwise be experienced without the benefits of the arrangement 136. Electricity can be passed through the coupling by means of electrical brushes and contacts (neither depicted) on the outside of the coupling 126.

Although the fluid coupling 126 is believed to be particularly suited for use between the rotating shafts 128 and 130, other arrangements, such as any of a variety of known slip-clutches and other slip couplings, may be used to dampen or reduce the torque changes, vibrations or shocks between the shafts 128 and 130 that would otherwise be transferred to the mating between the neck 36 of the ceiling fan 10 and the incandescent socket 38 of the fan supporting light fixture. If desired, although not preferred, the shafts 128 and 130 may be mechanically and rigidly connected to each other to directly support and rotate hub 12 and vanes 14 without a dampening coupling.

It should now be appreciated that the practice of the present invention provides various means in which the weight bearing limits of the ceiling fixtures normally housing a single incandescent socket 38 are accommodated, so that the neck 36 of the ceiling fan 10 may be inserted into the incandescent socket 38 of the ceiling fixture 16 without causing any structural or detrimental effects thereto, while still having the necessary electrical and mechanical connections provided by the incandescent socket 38. Further, the present invention may provide for a non-reversible motor having a direction that is preferentially selected to accommodate the tightening, rather than the loosening, of the mating between the neck 36 and the incandescent socket 38. Further still, the present invention may provide a cushioning effect so that any rotation of the shaft of the ceiling fan 10 does not unnecessarily disturb the mating between the neck 36 of the ceiling fan 10 and the incandescent socket 38 of the supporting light fixture 16.

Figure 5:
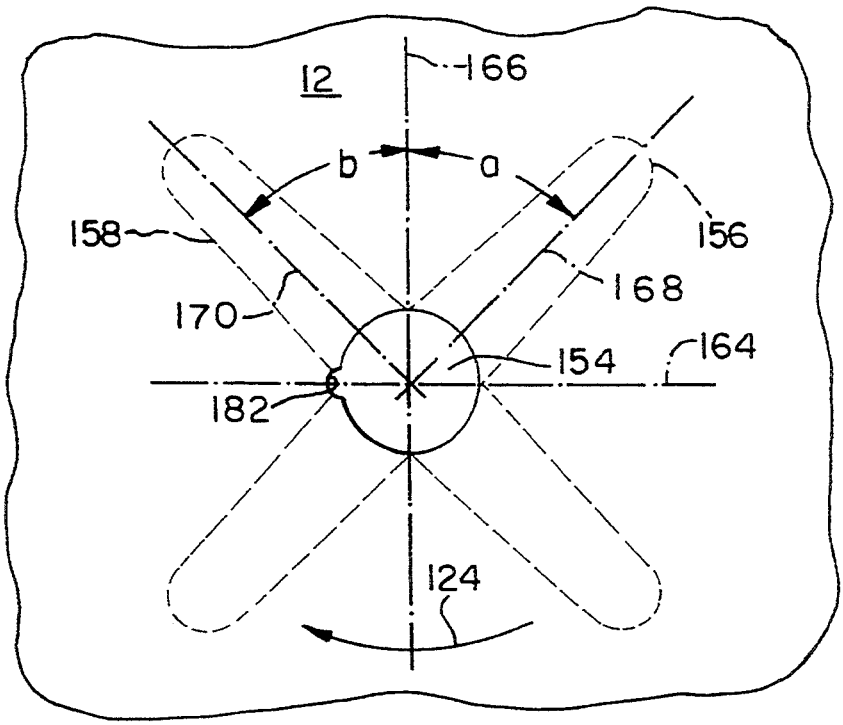
FIG. 5 illustrates the two different positions in which any of the vanes of the ceiling fan may be positioned.

The present invention has further benefits which are described with reference to FIGS. 5 and 6 in which FIG. 5 illustrates hub 12 as having the vanes 14 removed to more clearly show a vane receiving cavity indicted generally at 154 and two available vane positions 156 and 158 (indicated in phantom), which can be obtained by mounting any of the vanes 14 in the common cavity 154. The vanes 14 serve as blade screws that rotate about the fan central axis to move or produce a current of air. The positions 156 and 158 each provide a particular pitch for the vane 14, each of which positions produces an upward or downward air current, respectively, when the hub 12 rotates in the counter clockwise direction 124. FIG. 5 further illustrates the positions 156 and 158 relative to the predetermined orientation of the hub 12, defined by circumferential or horizontal ("x") and axial or vertical ("y") axes 164 and 166 respectively. Vertical axis 166 is parallel to the central axis of the fan 10 while horizontal axis 164 is defined generally by a plane perpendicular to axis 166, which may be viewed on edge at any desire radial location. Each of positions 156 and 158 has an elongated central axis with centerlines 168 and 170, respectively, that are offset or tilted from the vertical axis 166 by preferably, but not necessarily equal pitch angles a and b, respectively. In addition to providing two different vane positions, the present invention also allows for these positions to be easily and conveniently obtained.

Figure 6:
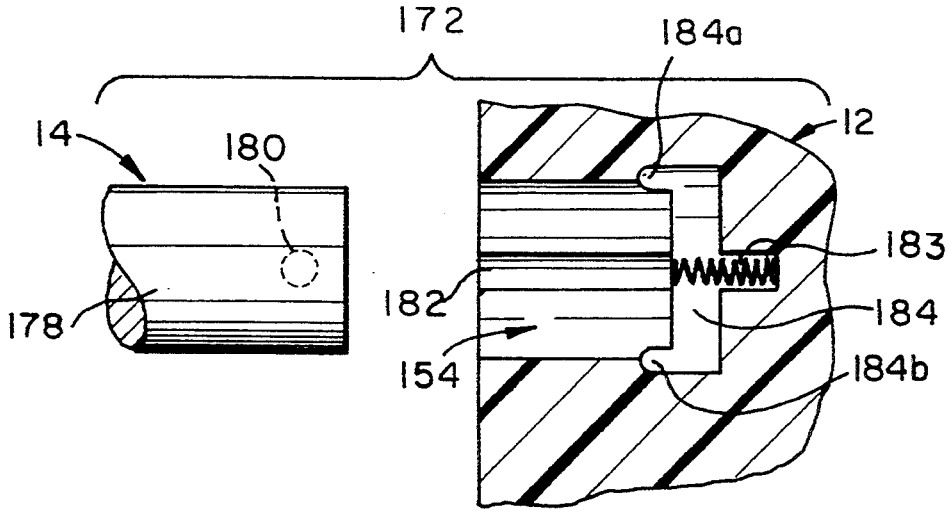
FIG. 6 illustrates one type of removable mounting of the vane.

FIG. 6 illustrates one type of a releasable and engageable coupling, a bayonet coupling indicated generally at 172, which might be used to adjustably secure vanes 14 to hub 12 in any of at least two or more pitch angles. Coupling 172 allows each of the vanes 14 to be removably attached to hub 12 and to be quickly moved between the pair of opposing pitch positions 156, 158 to permit selection or re-selection of the pitch positions so as to move air upward from beneath the fan or downward from above the fan.

Shaft member 178 supporting a remainder of the vane 14 has a protruding key member 180 (in phantom), which is received in a slot 182 extending axially into one of the cavities 154 of hub 12. Slot 182 terminates in a circumferential slot 184 deeper in hub 12, which extends above and below the axially extending slot 182 so as to permit the rotation of vane 14 around a central axis of shaft member 178 to either of the two vane positions 156 and 158. Recesses **184*a*, 184*b* at either end of circumferential slot 184 may be provided for receiving the key member 180. Suitable means such as a bias member in the form of a coil spring 183 may be provided in cavity 154 to contact the extreme inner end of shaft member 178 and bias key member 180 into either of the recesses 184*a*, 184*b* at opposing ends of slot 184, thereby releasably securing or "locking" the vane into the cavity 154 at the selected vane position 156 or 158**.

It should now be appreciated that the practice of the present invention not only provides for at least two different positions for orienting the vane 14, but also allows for the attainment of these positions in a convenient and quick manner.

It should be further appreciated that the practice of the present invention provides for various embodiments of a ceiling fan that are easily installed into an existing ceiling fixture that normally only accommodates an incandescent bulb. The principles of the present invention allow for the ceiling fan to be conveniently and easily mated with the incandescent socket which supplies its mechanical and electrical connections, thereby allowing the user of the ceiling fan to gain energy savings and convenience as realized in domestic, commercial or industrial applications.

From the foregoing descriptions, it can be seen that the present invention comprises a fan capable of direct engagement and operation with a standard light bulb fixture socket. It will be recognized by those skilled in the art that changes may be made to the above-described embodiments of the invention without departing from the broad inventive concepts thereof. It is understood therefore that this invention is not limited to the particular embodiments disclosed, but is intended to cover all modifications which are within the scope and spirit of the invention as defined by the appended claims.

I claim:

1. A ceiling fan adapted to engage a socket for an incandescent lamp of a ceiling fixture, said ceiling fan comprising:

(a) a neck with a conductive base shell having exposed, generally helical threads and a central contact at a distal end of the neck, the central contact being electrically isolated from said conductive base shell in the neck;

(b) an electric motor with a first shaft, said motor being coupled in circuit with said conductive base shell and said central contact;

(c) a hub rotated by said first shaft;

(d) a plurality of vanes radiating outwardly from said hub (e) a second shaft fixedly coupled to said hub; and (f) a slip coupling between said first shaft and said second shaft.

2. The ceiling fan according to claim 1 wherein said slip coupling comprises a torque transmission fluid coupling between said first shaft and said second shaft.

3. The ceiling fan according to claim 1, further comprising a housing having a power switch which is respectively electrically interposed between said motor and one of said central contact and said base shell.

4. The ceiling fan according to claim 1, further comprising a speed control circuit, including at least an off position, interposed electrically between said motor and one of said connections to said central contact and said base shell.

5. The ceiling fan according to claim 1, further comprising an on-off switch in circuit with said conductive shell and central contact of said neck and an incandescent bulb socket in said fan in circuit with said on-off switch.

6. The ceiling fan according to claim 1 wherein each vane is coupled with the hub in one of at least two selectable pitches with respect to a central axis of the fan.

7. The ceiling fan according to claim 6, further comprising a releasable engagement between each vane and the hub.

8. The ceiling fan according to claim 1, wherein said base shell helical threads run a first rotational direction extending towards said central contact and wherein said motor rotates said hub in an opposite rotational direction.

9. The ceiling fan according to claim 1, wherein said at least one vane has a paddle shape.

10. The ceiling fan according to claim 1, wherein said motor is non-reversible.

11. The ceiling fan of claim 1 in which said neck is threadingly engaged with a threaded socket of a light bulb fixture.

12. The ceiling fan according to claim 11, wherein said ceiling light fixture further comprises an on-off switch having a pull member and wherein said ceiling fan further comprises a housing, the pull member being secured to said housing above the at least one vane of said ceiling fan.

13. The ceiling fan according to claim 1 in which said neck is threadingly engaged with a threaded socket of a light bulb fixture extending from a ceiling.

14. The ceiling fan according to claim 13 wherein each of the vanes is at least one-half foot long.

15. The ceiling fan according to claim 14 wherein each of the vanes has a hollow interior.

16. The ceiling fan according to claim 13 further comprising a housing surrounding the motor and a clip on the housing configured to receive a pull member of the ceiling fixture.

* * * * *